US010015855B2

(12) United States Patent
Ferrier

(10) Patent No.: US 10,015,855 B2
(45) Date of Patent: Jul. 3, 2018

(54) DITHERING AND DIMMING TECHNIQUES FOR LIGHT EMITTING DIODE (LED) LIGHTING SYSTEMS

(71) Applicant: Lumenetix, Inc., Scotts Valley, CA (US)

(72) Inventor: Herman Ferrier, Scotts Valley, CA (US)

(73) Assignee: LUMENETIX, INC., Scotts Valley, CA (US)

( * ) Notice: Subject to any disclaimer, the term of this patent is extended or adjusted under 35 U.S.C. 154(b) by 0 days.

(21) Appl. No.: 15/383,402

(22) Filed: Dec. 19, 2016

(65) Prior Publication Data

US 2017/0181238 A1 Jun. 22, 2017

Related U.S. Application Data

(60) Provisional application No. 62/269,049, filed on Dec. 17, 2015.

(51) Int. Cl.
*H05B 37/00* (2006.01)
*H05B 33/08* (2006.01)

(52) U.S. Cl.
CPC ..... *H05B 33/0845* (2013.01); *H05B 33/0815* (2013.01); *H05B 33/0818* (2013.01)

(58) Field of Classification Search
CPC ..... H05B 33/0815; H05B 33/0845; H05B 33/0863
USPC ..... 315/185 R, 193
See application file for complete search history.

(56) References Cited

U.S. PATENT DOCUMENTS

| | | | | |
|---|---|---|---|---|
| 9,433,046 | B2 * | 8/2016 | Grajcar | H05B 33/0824 |
| 9,538,601 | B1 * | 1/2017 | Mangtani | H05B 33/0854 |
| 2008/0122376 | A1 * | 5/2008 | Lys | H05B 33/0857 315/192 |
| 2010/0072902 | A1 * | 3/2010 | Wendt | H05B 33/0818 315/161 |
| 2015/0257223 | A1 * | 9/2015 | Siessegger | H05B 33/0818 315/186 |
| 2017/0111970 | A1 * | 4/2017 | Chobot | H05B 33/0863 |

* cited by examiner

*Primary Examiner* — Tung X Le
(74) *Attorney, Agent, or Firm* — Perkins Coie LLP

(57) ABSTRACT

Various embodiments are described herein that relate to systems and methods for selectively providing current to power LEDs. The techniques introduced here can enable smooth dimming of the LEDs from maximum brightness down to "actual extinction" or "pseudo-extinction." More specifically, the LEDs can be dimmed to extinction without any significant gaps in the levels of brightness (i.e., a noticeable drop rather than a smooth transition between brightness levels). Various pulse width modulation (PWM) and shunting techniques may be used to control the power provided to each color channel of an LED board. Conventionally, PWM often causes LEDs to produce an undesirable acoustic effect. However, by dithering the PWM signals between multiple predetermined positions once the frequency enters the audible range (e.g., below 25 kHz), the cumulative acoustic effect instead becomes white noise.

18 Claims, 17 Drawing Sheets

| Phase | Description // Type of Dimming | Dimming Range (%) |
|---|---|---|
| Stage One | Current control of integrated circuit used for top 80% (200 kHz at 100%, 1 MHz at 20%). | 100% to 20% |
| Stage Two | Current held at 20% dim level at 25kHz frame rate by integrated circuit. Fast shunt uses PWM to divert current for short periods of time. | 20% to 0.3% |
| Stage Three | Micro Pulse 1 maintains a 10 mA current at 25 kHz frame rate and uses PWM to vary the brightness. | 0.3% to 0.00001% |
| Stage Four | Micro Pulse 2 maintains the 10 mA current but increases frame width from 25 kHz to 50 Hz. | Additional 500:1 possible |

FIG. 2

DITHERING AND DIMMING TECHNIQUES FOR LIGHT EMITTING DIODE (LED) LIGHTING SYSTEMS

CROSS-REFERENCE TO RELATED APPLICATIONS

This application claims priority to and the benefit of U.S. Provisional Application No. 62/269,049, entitled "Dithering and Dimming Techniques for Light Emitting Diode (LED) Lighting Systems" filed on Dec. 17, 2015.

FIELD OF THE INVENTION

Various embodiments concern firmware modification and, more specifically, techniques for modifying power signals for LED-based lighting systems.

BACKGROUND

Traditional lighting systems typically rely on conventional lighting technologies, such as incandescent bulbs and fluorescent bulbs. But these light sources suffer from several drawbacks. For example, such light sources do not offer long life or high energy efficiency. Moreover, such light sources offer only a limited selection of colors, and the color of light output by these light sources generally changes over time as the bulbs age and begin to degrade. Consequently, light emitting diodes (LEDs) have become an attractive option for many applications. The vast majority of LED-based lighting systems, however, use fixed white LEDs with no tunable range.

Although LED-based systems are capable of having longer lives and offering high energy efficiency, several issues still exist including the degradation of color over time and the responsiveness of color tuning adjustments. These issues can be compounded when multiple LED-based lighting systems are placed near one another or are coupled directly to one another.

Moreover, printed circuit board assemblies (PCBAs) with LEDs often exhibit undesirable acoustic effects when the PCBAs are driven at particular (e.g., resonant) frequencies in the human hearing range (e.g., approximately 50 Hz to 25 kHz). For instance, sound may be produced by vibrating capacitors, such as piezoelectric ceramic capacitors that change dimensions in response to an applied voltage. Some inductors may also create noise by magnetostriction. Although solutions (e.g., specialty dampeners, low drive acoustic capacitors) have been proposed in an effort to reduce or eliminate these acoustic effects, this problem continues to plague PCBAs regardless of application (i.e., not just when used as part of a lighting system).

A light source can be characterized by its color temperature and by its color rendering index (CRI). The color temperature of a light source is the temperature at which the color of light emitted from a heated black body radiator is matched by the color of the light source. For a light source that does not substantially emulate a black body radiator, such as a fluorescent bulb or LED, the correlated color temperature (CCT) of the light source is the temperature at which the color of light emitted from a heated black body radiator is approximated by the color of the light source.

The CCT can also be used to represent chromaticity of white light sources. But because chromaticity is two-dimensional, Duv (as defined in ANSI C78.377) can be used to provide another dimension. When used with a MacAdam ellipse (which represents the colors distinguishable to the human eye), the CCT and Duv allow the visible color output by an LED-based lighting system to be more precisely controlled (e.g., by being tuned).

The CRI, meanwhile, is a rating system that measures the accuracy of how well a light source reproduces the color of an illuminated object in comparison to an ideal or natural light source. The CRI is determined based on an average of eight different colors (R1-R8). A ninth color (R9) is a fully saturated test color that is not used in calculating CRI, but can be used to more accurately mix and reproduce the other colors. The CCT and CRI of LEDs is typically difficult to tune and adjust. Further difficulty arises when trying to maintain an acceptable CRI while varying the CCT of an LED.

BRIEF DESCRIPTION OF THE DRAWINGS

Various objects, features, and characteristics will become more apparent to those skilled in the art from a study of the following Detailed Description in conjunction with the appended claims and drawings, all of which form a part of this specification. While the accompanying drawings include illustrations of various embodiments, the drawings are not intended to limit the claimed subject matter.

FIG. 2 depicts four-stage process for dimming LEDs to extinction.

Figure 1A:
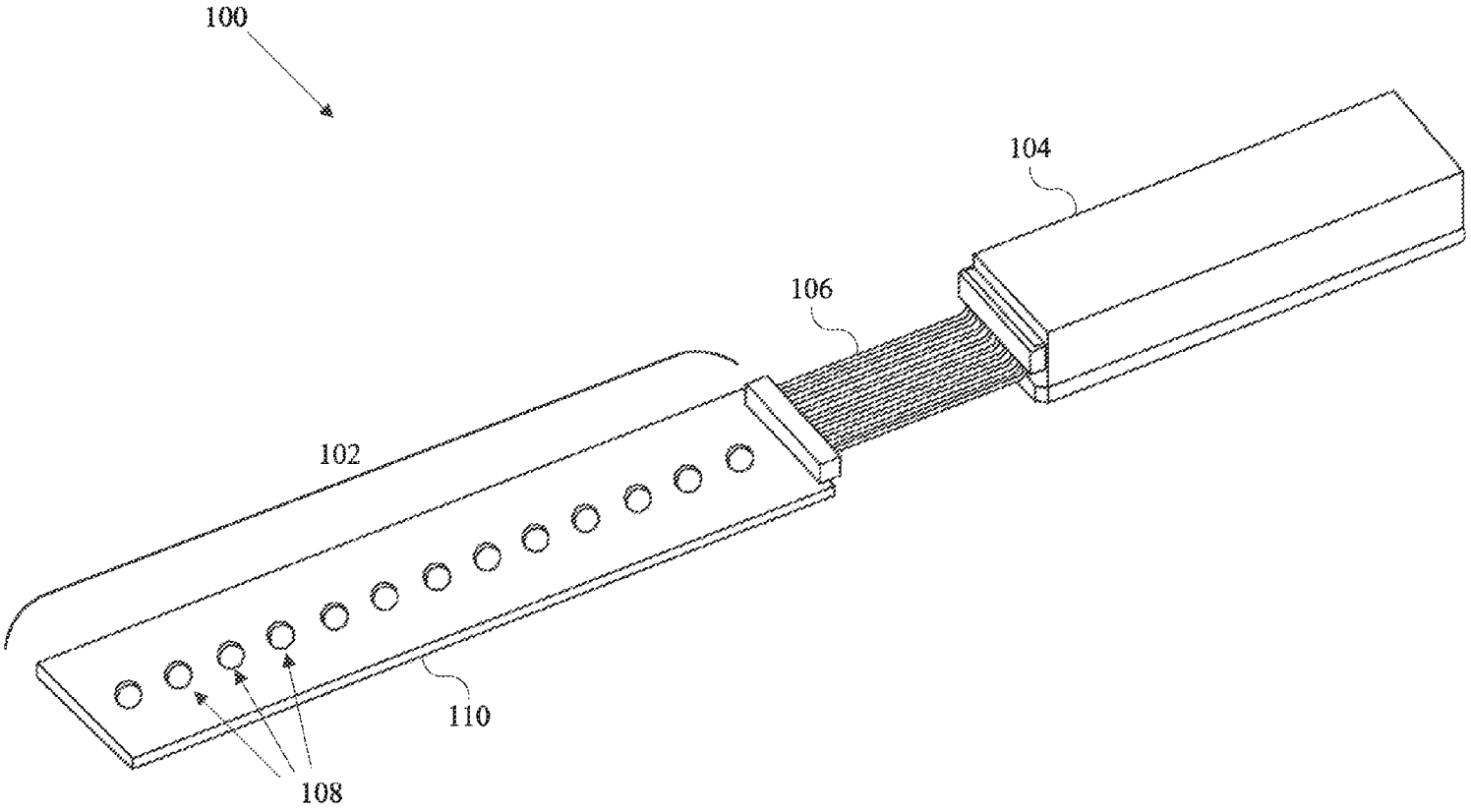
FIG. 1A depicts an example of an LED-based lighting system that includes an LED board coupled to a logic module by a ribbon cable as may occur in various embodiments.

The figures depict various embodiments described throughout the Detailed Description for purposes of illustration only. While specific embodiments have been shown by way of example in the drawings and are described in detail below, the embodiments are amenable to various modifications and alternative forms. The intention is not to limit the disclosure to the particular embodiments described. Accordingly, the claimed subject matter is intended to cover all modifications, equivalents, and alternatives falling within the scope of the invention as defined by the appended claims.

DETAILED DESCRIPTION

Various embodiments are described herein that relate to techniques for dimming LEDs. More specifically, various embodiments relate to systems and methods for selectively providing current to power LED boards, fixtures, etc., that allow the brightness level of the LEDs to be more precisely controlled. The techniques introduced here enable the LEDs to be smoothly dimmed from maximum brightness down to "actual extinction" (e.g., where an individual is not able to see any light despite looking straight at the LED) or "pseudo-extinction" (e.g., where the individual is not able to any light reflected off of most materials). For example, the techniques may allow brightness to be dimmed from 100% down to 0.00001% brightness (and, in some instances, even lower). For actual extinction, the reduction in maximum luminous flux may be from 100 million to 1, while for pseudo-extinction the reduction in maximum luminous flux may be from 10 million to 1. The systems and techniques described herein allow a user to dim LEDs to extinction without any significant gaps in the available levels of brightness (i.e., a noticeable drop rather than a smooth transition between brightness levels).

More specifically, pulse width modulation (PWM) and shunting techniques may be used to control the power provided to each color channel of an LED board. The power (and brightness) can be more precisely controlled by simultaneously modifying the PWM and the duty cycle of the circuit(s) involved.

PWM signals also generally cause LEDs to produce an undesirable acoustic effect (e.g., by vibrating the capacitors on the PCBA). By dithering the PWM signals between multiple predetermined positions once the frequency enters the audible range (e.g., below 25 kHz), the cumulative acoustic effect can become white noise. However, as further described below, in many instances dithering is not necessary when the frequency falls below 25 kHz because the amplitude of the input current is so small the resulting acoustic effects are negligible.

The technologies introduced herein can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to program a computer (or another electronic device) to perform a process. The machine-readable medium may include, but is not limited to, floppy diskettes, optical disks, compact disk read-only memories (CD-ROMs), magneto-optical disks, read-only memories (ROMs), random access memories (RAMs), erasable programmable read-only memories (EPROMs), electrically erasable programmable read-only memories (EEPROMs), magnetic or optical cards, flash memory, or any other type of media/machine-readable medium suitable for storing electronic instructions.

TERMINOLOGY

Brief definitions of terms, abbreviations, and phrases used throughout this application are given below.

Reference in this specification to "one embodiment" or "an embodiment" means that a particular feature, structure, or characteristic described in connection with the embodiment is included in at least one embodiment of the disclosure. The appearances of the phrase "in one embodiment" or "in some embodiments" in various places in the specification are not necessarily all referring to the same embodiment(s), nor are separate or alternative embodiments mutually exclusive of other embodiments. Moreover, various features are described which may be exhibited by some embodiments and not by others. Similarly, various requirements are described which may be requirements for some embodiments but not other embodiments.

Unless the context clearly requires otherwise, throughout the Detailed Description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. For example, two devices may be coupled directly, or via one or more intermediary channels or devices. As another example, devices may be coupled in such a way that information can be passed there between, while not sharing any physical connection with one another. Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list.

If the specification states a component or feature "may," "can," "could," or "might" be included or have a characteristic, that particular component or feature is not required to be included or have the characteristic.

The term "module" refers broadly to software, hardware, or firmware (or any combination thereof) components. Modules are typically functional components that can generate useful data or other output using specified input(s). A module may or may not be self-contained.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same, in the same context, whether or not it is highlighted. It will be appreciated that same element can be described in more than one way.

Consequently, alternative language and synonyms may be used for any one or more of the terms discussed herein. However, special significance is not to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and is not intended to further limit the scope and meaning of the disclosure or of any exemplified term. Likewise, the disclosure is not limited to various embodiments given in this specification.

System Topology Overview

FIG. 1A depicts an example of an LED-based lighting system 100 that includes an LED-based light source, such as an LED board 102, coupled to a logic module 104 (which may also be referred to as a color tuning module) by a ribbon cable 106. By separating one or more processing components (e.g., processors, drivers, power couplings) from the LED board 102, the techniques described herein enable the necessary driver(s), processor(s), etc., to be housed within the logic module 104 rather than on the LED board 102. Consequently, the LED board 102 can be intelligently controlled by the logic module 104, despite the LED board 102 not retaining the necessary components itself.

Although the LED board 102 is illustrated by FIG. 1A as an array of LEDs 108 positioned linearly on a substrate, other arrangements are also possible and, in some cases, may be preferable. For example, the LED board 102 may include a circular arrangement or cluster of mid-power LEDs, a single high power LED, or some other lighting feature.

Dimming to Extinction

Figure 1B:
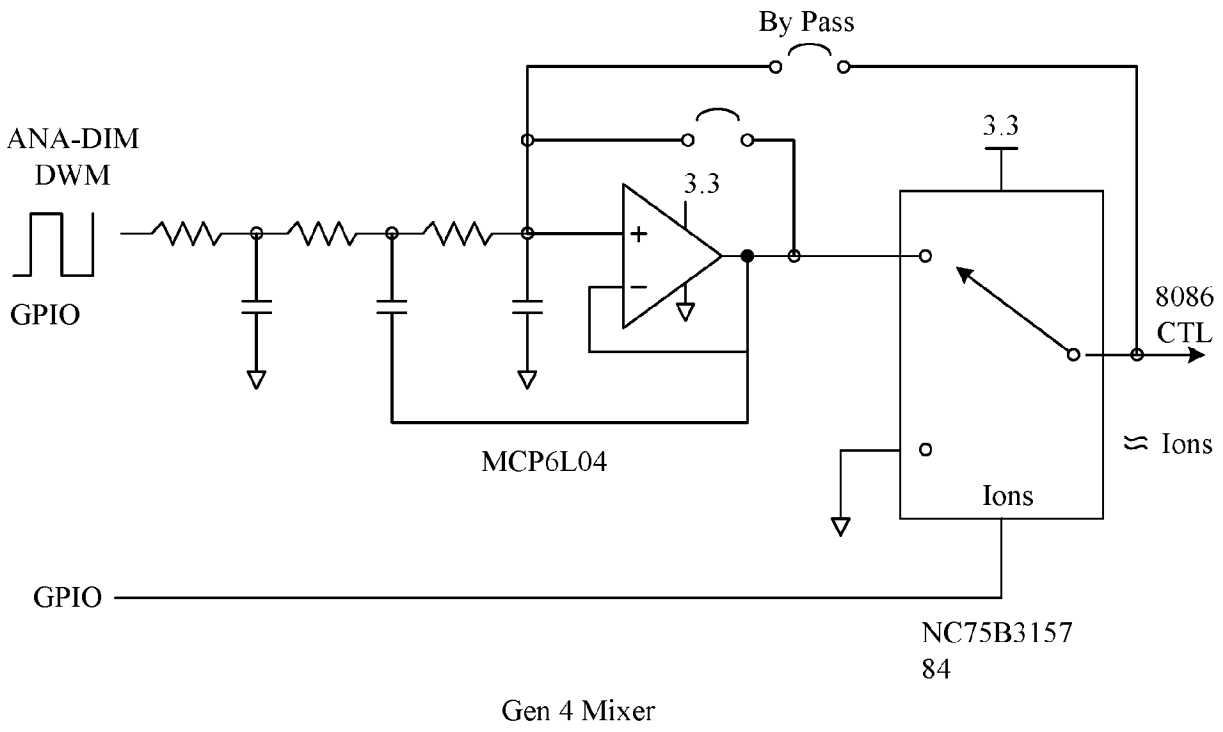
FIG. 1B depicts an example circuit that is able to facilitate the dimming process described herein.
Figure 1C:
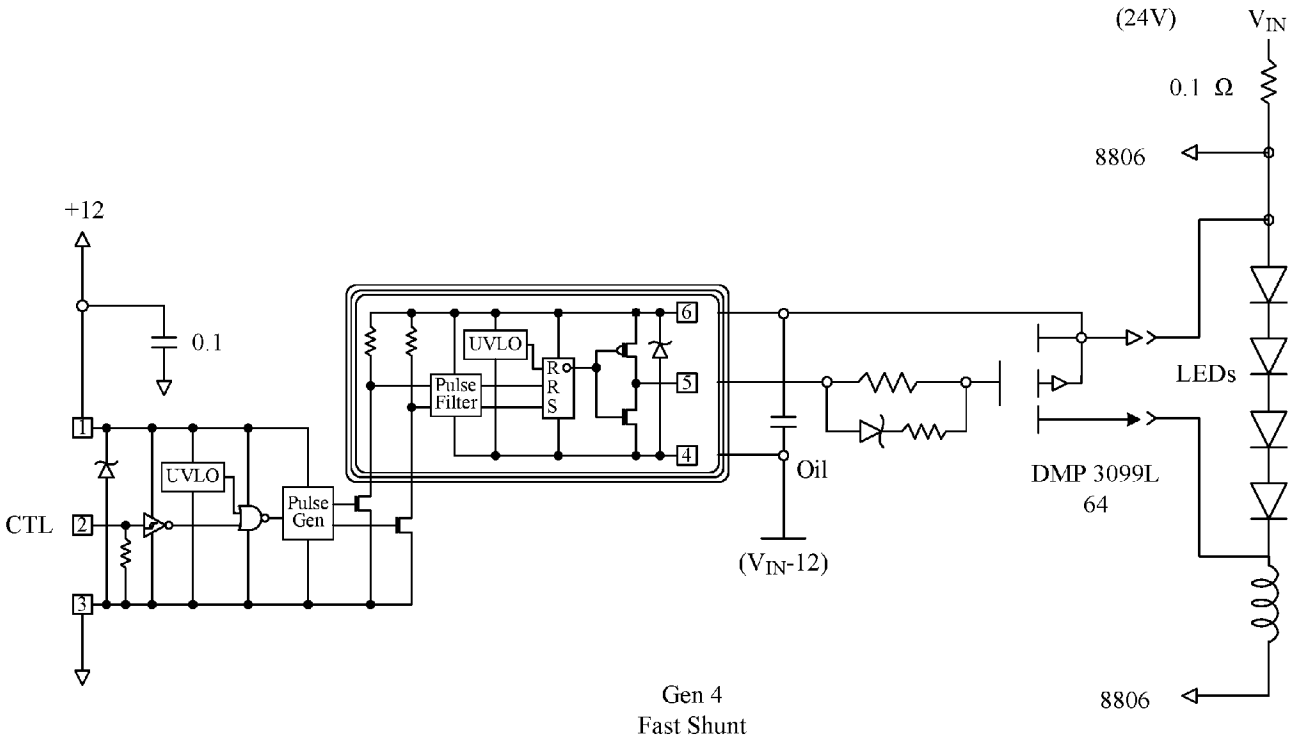
FIG. 1C depicts another example circuit that is able to facilitate the dimming process described herein.
Figure 1D:
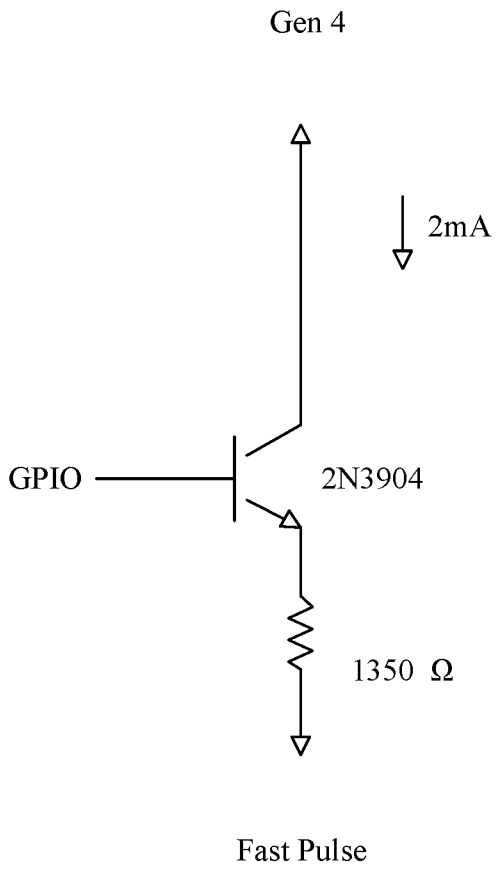
FIG. 1D depicts another example circuit that is able to facilitate the dimming process described herein.
Figure 1E:
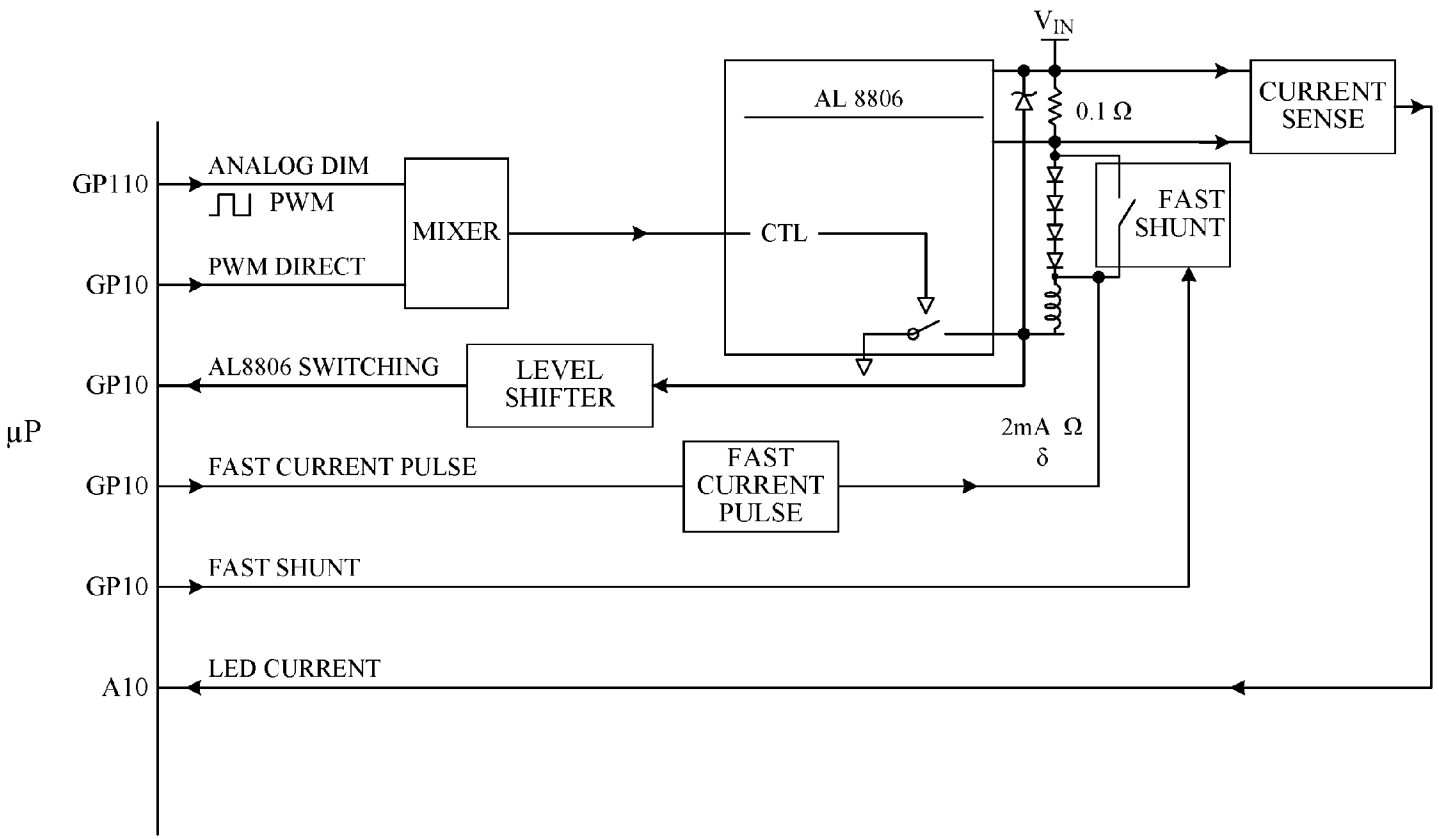
FIG. 1E depicts another example circuit that is able to facilitate the dimming process described herein.

FIGS. 1B-G depict various example circuits that are able to facilitate the dimming process described herein. For example, FIG. 1B depicts an integrated "mixer" circuit that can be used to controllably provide current to the LED(s), while FIG. 1C depicts a "fast shunt" that can divert current and thereby decrease input current. FIG. 1D, meanwhile, depicts a "fast pulse" circuit that can be used to quickly provide small amounts of input current with minimal rise time. FIG. 1E provides a high-level overview of the circuit assembly as a whole, which is able to perform the dimming techniques described herein.

Many conventional lighting systems offer a dimming function (i.e., are "dimmable") that allows a user to selectively control how much light a particular light source produces. By dimming the light source, the user is able to modify the brightness of the light source. More specifically, the dimming process described here allows the LEDs to be smoothly dimmed from maximum brightness down to "actual extinction" (e.g., where an individual is not able to see any light despite looking straight at the LED) or "pseudo-extinction" (e.g., where the individual is not able to any light reflected off of most materials). Smooth transitions between the different brightness levels generally require that each color channel of an LED board have minimal error (e.g., within a couple percent).

Because LEDs can be rapidly switched on and off, dimming has traditionally been accomplished using PWM. More specifically, the apparent intensity/brightness of an LED could be dimmed by adjusting the relative duration of each pulse of current supplied to the LED and the time between pulses. However, these pulses must occur with a high enough frequency that the LED appears to be continuously lit, otherwise flickering will result. Because of this limitation and others, once the user reaches a predetermined brightness threshold, the LEDs of conventional lighting systems shut off entirely. Said another way, once the brightness level reaches a predetermined lower threshold, the LEDs shut off entirely, which is easily noticeable by a user.

Generally, a compromise must be made between frame rate (i.e., corresponds to the frequency, or the inverse of the time period over which a pulse, or series of pulses, repeats itself), resolution (i.e., the maximum number of pulses that are able to fit into a period; generally measured in bits), and flicker. For example, as the frequency increases, PWM resolution typically decreases. As such, certain frequencies (e.g., 1 kHz) could be identified that provide a compromise between these competing interests.

Introduced here is a four-stage process for dimming the visible light produced by an LED to extinction without generating noticeable flickering or gaps in the visible spectrum. The process, as shown in FIG. 2, can be used to separately or simultaneously dim the color channels of an LED board.

The dimming range of stage one typically extends from 100% (i.e., full brightness) to approximately 20%. The dimming range of stage two typically extends from 20% to approximately 0.3%. The dimming range of stage three typically extends from 0.3% to approximately 0.00001%. Stage four, meanwhile, is able to provide an additional 500:1 reduction in brightness. The numbers listed here refer to the approximately percentage of full brightness that is governed by each stage. One skilled in the art will recognize these numbers are approximations and that modifications to the dimming techniques described here, such as using different circuits, may affect the cutoffs and ranges of each stage.

Figure 3A:
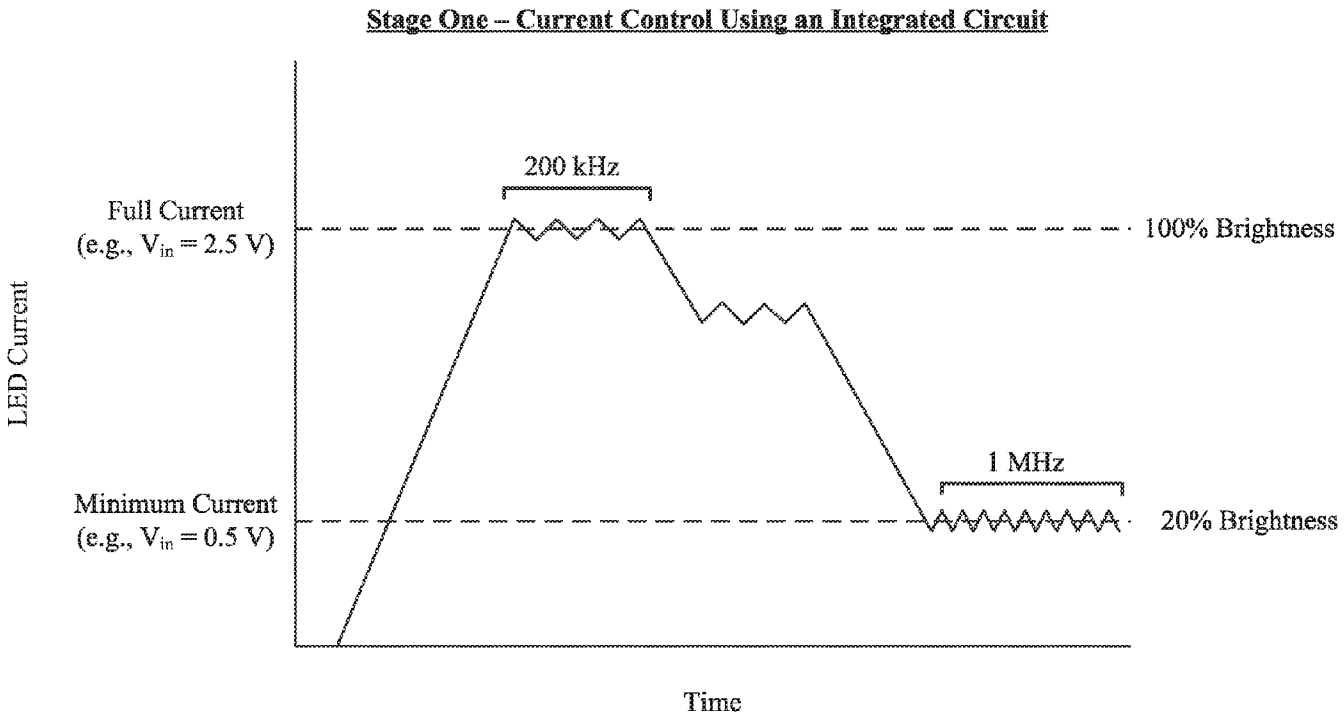
FIG. 3A depicts a first stage of a process for modifying the current supplied to one or more LEDs, thereby decreasing brightness.

As shown in FIG. 3A, stage one utilizes an integrated circuit that is able to provide a consistent (i.e., controlled) level of current in response to receiving an input voltage between 0.5V and 2.5V. The input voltage is generated (e.g., by a logic module) using PWM and a duty cycle in combination with an RC circuit that allows the input signal to be easily converted from digital to analog.

More specifically, the integrated circuit is configured to produce a maximum current (i.e., LED at 100% brightness) at 20 kHz when the input voltage exceeds 2.5V and a minimum current (i.e., LED at 20% brightness) at 1 MHz when the input voltage is 0.5V. Between 0.5V and 2.5V, the integrated circuit is able to generate a regulated current that is linearly based on the input voltage. That is, an input voltage between 0.5V and 2.5V allows the integrated circuit to produce an intermediate level of current that is based on the input voltage.

The integrated circuit can also be readily turned on and off (e.g., using a transistor-transistor logic (TTL)). As illustrated in FIG. 3A, the integrated circuit is able to substantially maintain the current at or near the appropriate level (e.g., using resistors).

Figure 3B:
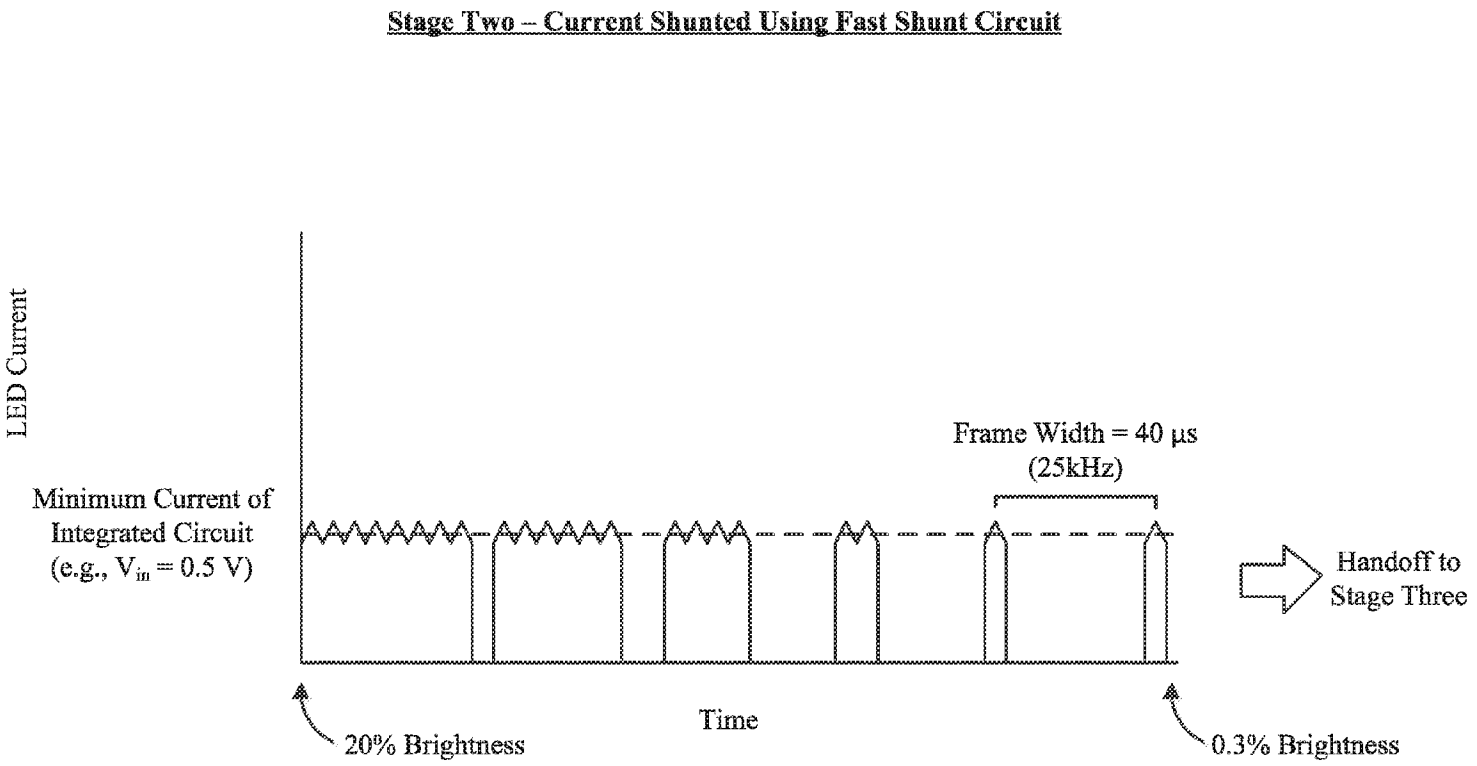
FIG. 3B depicts a second stage of the process.

As shown in FIG. 3B, stage two utilizes a second circuit (a "fast shunt") that modulates the effects of the integrated circuit described above by selectively shunting the current provided by the integrated circuit (as described above). Dimming within stage two requires several steps be performed. First, an input voltage of 0.5V is provided to the integrated circuit, which causes the brightness level to remain steady at 20%. Second, the fast shunt is turned off and on at various frequencies to achieve a desired brightness level.

For example, when the input voltage equals 0.5V and the duty cycle of the fast shunt is 100%, the brightness level remains at 20%. As the fast shunt is turned off for increasing segments of time and the duty cycle decreases, the brightness level decreases accordingly. Stage two is enabled by the ability of the fast shunt to quickly turn on and off (e.g., on the order of 100 nanoseconds), where the integrated circuit generally takes about 3 microsecond to turn on or off. FIG. 3B illustrates a scenario where a fixed frame width experiences less current as the duty cycle of the fast shunt decreases. But the fast shunt still experiences a lower limit as to how much the frame width can be decreased before flickering occurs. This lower limit is influenced by various factors, including the rise time of the input current produced by the integrated circuit and fast shunt and/or digital control limits of the FPGA. Once the frame width reaches approximately 40 microseconds (i.e., a frequency of 25 kHz), a handoff occurs between stage two and stage three.

Stages one and two typically utilize a buck converter (i.e., a voltage step down and current step up converter) as the current driver, while stages three and four utilize an analog driver. Buck converters (e.g., AL 8806) offer a simply way to modify the input current/voltage for each color channel, but are often limited in their responsiveness and accuracy. Consequently, one or more analog drivers are preferably used as the input current decreases (i.e., as responsiveness and rise time become increasingly important).

Figure 3C:
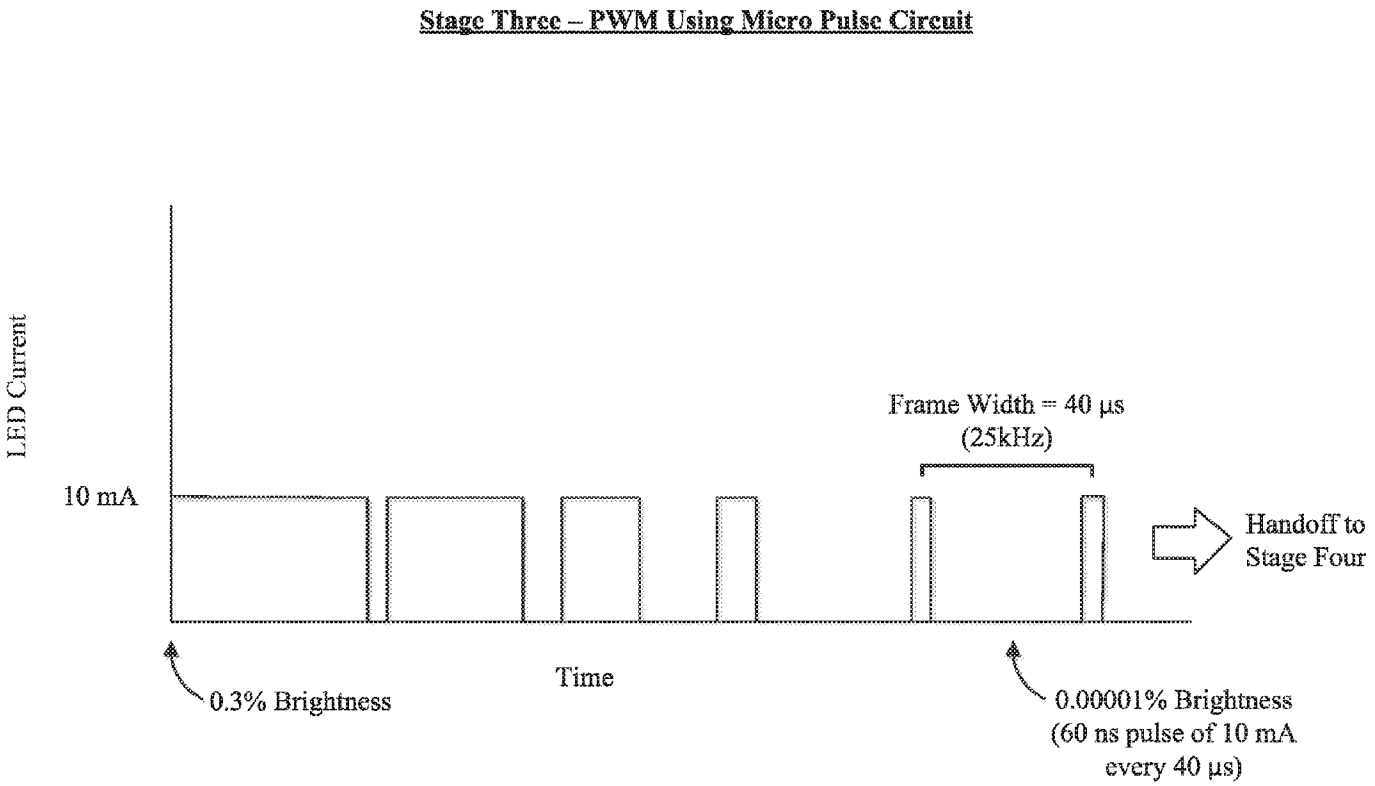
FIG. 3C depicts a third stage of the process.

As shown in FIG. 3C, stage three utilizes a third circuit ("micro pulse circuit") that uses PWM to produce a small current (e.g., 10 milliamps). The micro pulse circuit generally takes about 10 nanoseconds to turn on and off, which allows the output current to be controlled at a high resolution.

During stage three, neither the integrated circuit nor the fast shunt are used to generate the output current. As such, a "handoff" must occur between the integrated circuit and fast shunt in stage two and the micro pulse circuit in stage three. A substantially seamless (i.e., unnoticeable) handoff between the two stages requires that the brightness level generated by the micro pulse circuit at maximum current and maximum duty cycle substantially matches the brightness level generated by the integrated circuit and fast shunt at minimum current and minimum duty cycle. The pulses provided by both the fast shunt and the micro pulse circuit remain 25 kHz, which is out of acoustic range and typically does not experience problems with flickering.

To decrease the brightness level further, the duty cycle of the micro pulse circuit is decreased until the minimum brightness is reached before the LED would appear to turn off (e.g., a 10 milliamp pulse every 40 microseconds).

Figure 3D:
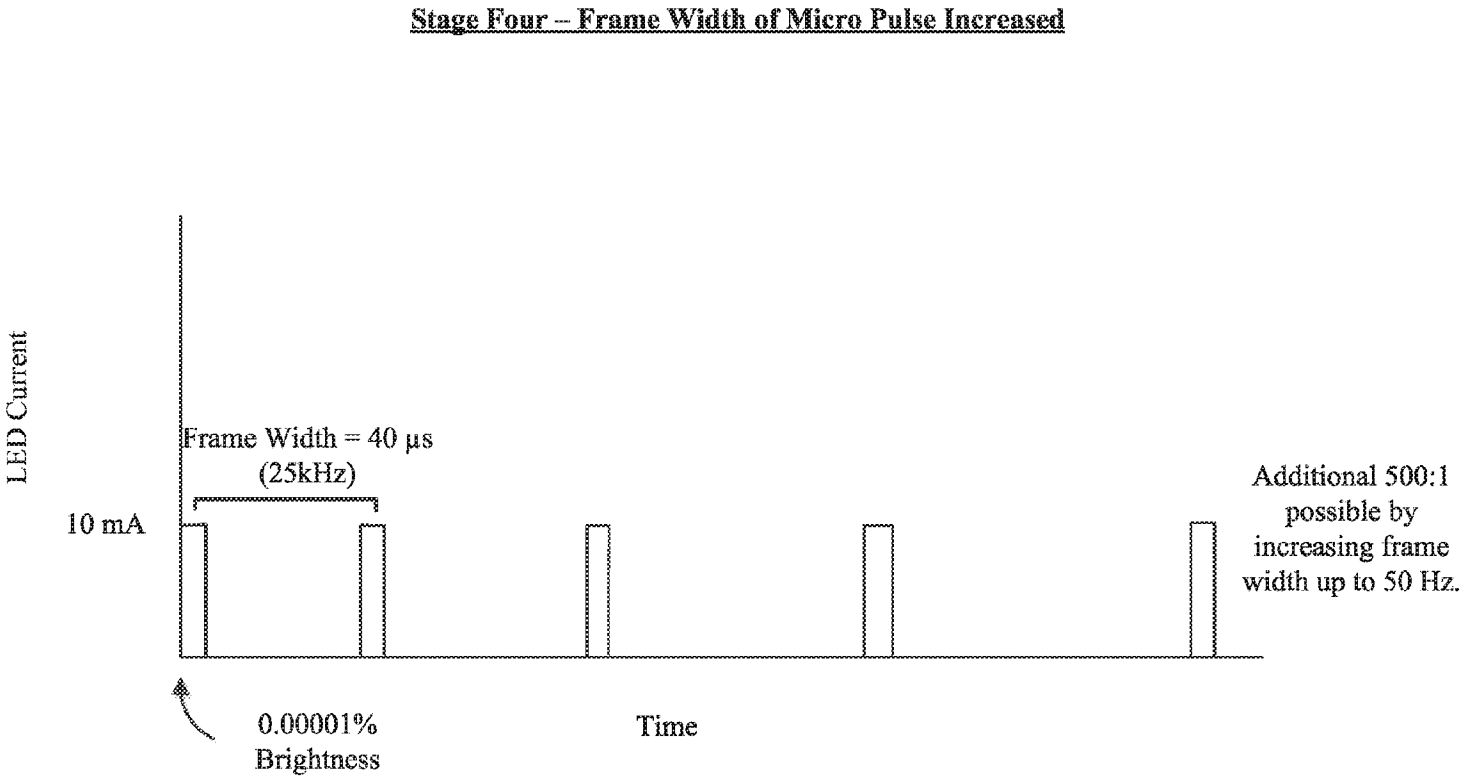
FIG. 3D depicts a fourth stage of the process.

As illustrated in FIG. 3D, stage four stretches out the frame width of the minimum current supplied by the micro pulse circuit. That is, the minimum current is supplied less frequently (e.g., a 10 milliamp pulse is supplied every 60, 80, or 100 microseconds). Stretching of the frame width causes the frequency of the signal to incrementally decrease. For example, some embodiments may be configured to decrease the frequency of the pulses of current from 25 kHz to 50 Hz.

Stages two, three, and four (in priority order) could be completed as many times as necessary to meet certain "dim to extinction" objectives. For example, in some embodiments, stages two, three, and four may be logically replicated to decrease the brightness even further than the lowest level made possible by stage four. However, as the frequency decreases, certain compromises may need to be made (e.g., with respect to flickering and acoustics).

The dimming stages described above could also be delayed by a certain period of time. For example, a user may elect to turn an LED-based light source off entirely, and a logic module could delay decreasing the brightness. As another example, a user might simply elect a brightness level, and the logic module may decrease or increase the brightness over time to reach the specified brightness level.

Example Embodiment

Figure 1F:
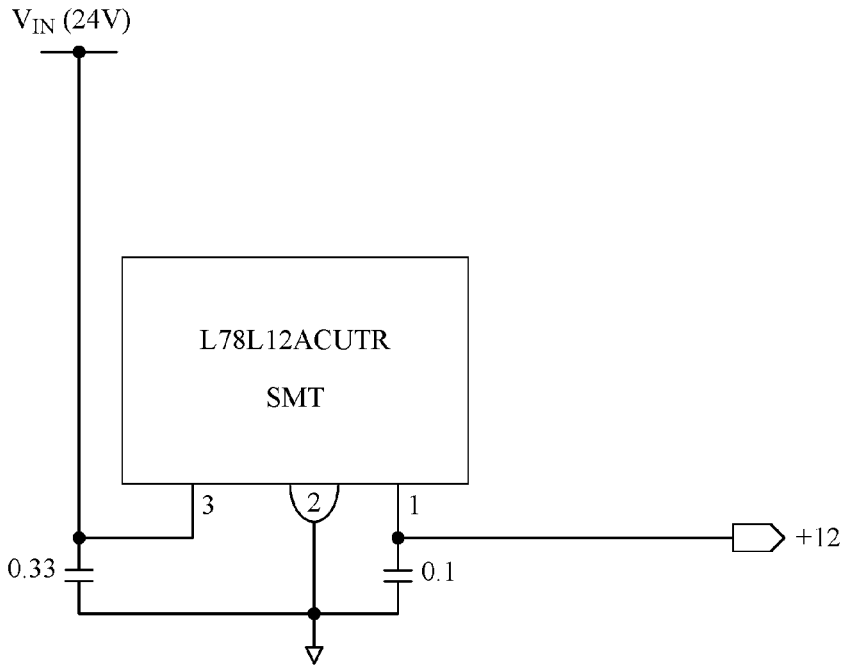
FIG. 1F depicts another example circuit that is able to facilitate the dimming process described herein.
Figure 1G:
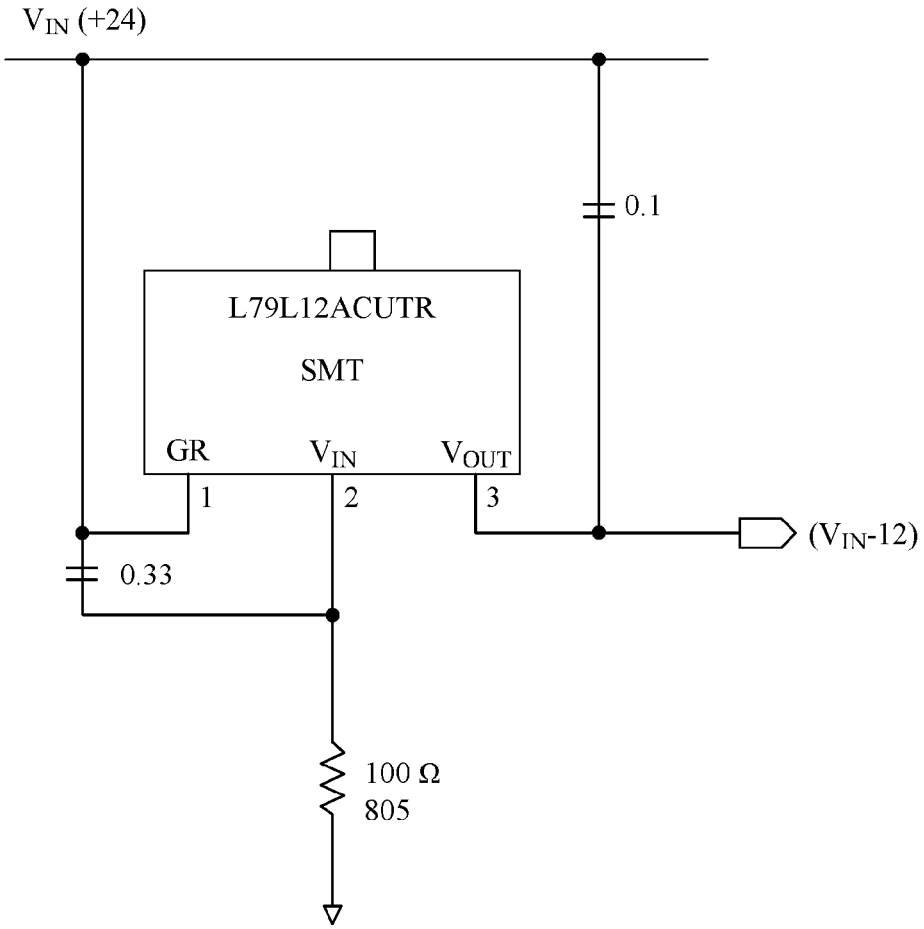
FIG. 1G depicts another example circuit that is able to facilitate the dimming process described herein.

Looking now at FIGS. 1B-1G, a buck converter (e.g., AL 8806) has a single control input to provide both digital PWM and analog dimming; however, a mixer is required to provide both functions (as shown in FIG. 1F). The analog command is created at point A by a PWM signal from the microprocessor. The PWM signal is smoothed by the low pass filter composed of $R_1$, $R_2$, $R_3$, $C_1$, $C_2$, $C_3$, and the operational amplifier ("op amp"). When the switch (S1) is connected to point A, a voltage varying from 0.5 V to 2.5 V controls the buck converter output current, which typically ranges from 0.2 A to 1.0 A. This current range is used to achieve the first 5 to 1 dimming range.

The next dimming range is achieved using the fast shunt. The fast shunt gives much better control than the PWM built into the buck converter. The reason for this is that the buck converter, when used to perform PWM, turns off its switching FET. While this is effective for turning off the LED current during the "on" portion of the buck converter's switching cycle, it is not effective during the "off" portion of the buck converter's switching cycle. This problem is eliminated by using a fast shunt that bypasses the current around the LED string, thus turning off the LED current at any time.

The final dimming ranges are achieved using an analog PWM current source. The analog PWM current source is modulated at a 25 kHz rate to achieve even further dimming (e.g., down to "actual extinction" or "pseudo-extinction"). The additional dimming can be achieved by lengthening the frame rate (i.e., reducing the PWM frequency). Although this brings the current modulation into the audible range, the current is so low that it is generally inaudible. However, if an undesirable acoustic effect is determined to be present, another circuit can be used to completely remove current modulation of the input source. This circuit instead draws constant current from the input source and switches the current between the LED(s) and ground.

Field-Programmable Gate Array (FPGA) Dithering

Figure 4:
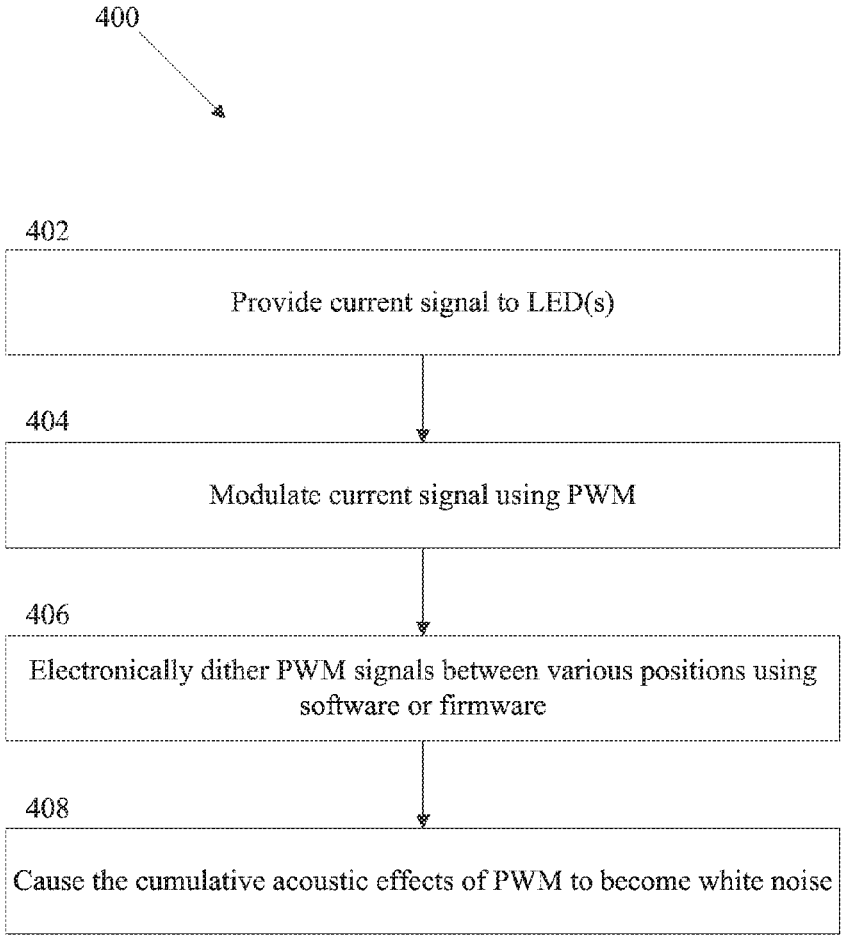
FIG. 4 depicts a process for substantially eliminating the acoustic effects of PWM using software or firmware.

FIG. 4 depicts a process 400 for substantially eliminating the acoustic effects of PWM using software or firmware. As noted above, PWM may be used to control the power provided to each color channel of an LED board (steps 402 and 404). More specifically, a logic module may controllably provide current to one or more LED(s) using PWM, which allows the logic module to more precisely control the brightness of those LEDs. PWM signals, however, cause the LED to produce an acoustic effect (e.g., by exciting and vibrating the components of the LED board, such as the capacitors, the caps, and the board itself) when produced at a frequency within the audible range (e.g., less than 25 kHz). By electronically dithering the PWM signals using software or firmware (step 406), the undesirable acoustic effect can be changed to white noise (step 408), which largely mitigates, if not substantially eliminates, the problem.

Dithering the PWM signals in such a manner can remedy several different issues. For example, setting the frequency of the modulated signal to a higher value (e.g., 25 kHz rather than 1 kHz) eliminates acoustic noise, while also eliminating electronic flicker (also referred to as "e-flicker") that causes visible changes in the brightness of an electronic display (e.g., the screen of a mobile phone). E-flicker can be particularly problematic when trying to capture video of a scene due to a mismatch between the frame rate and the camera shutter speed.

Rather than offset the PWM signals back and forth between two positions (as would occur if the PWM signal was dithered using conventional techniques), the PWM signals are instead offset to a greater number of predetermined positions (e.g., 32 different positions), which causes the cumulative acoustic effect to effectively become white noise.

Note, however, that dithering is typically only necessary if the frequency of the modulated signal is less than 25 kHz. If the frequency of the modulated signal exceeds 25 kHz, the frequency is outside of the audible range and dithering is unnecessary. Thus, the dithering techniques described here may only be necessary during step four of the four-step dimming process described above. In fact, some embodiments may violate the 25 kHz limitation (i.e., go under this threshold) and not perform any dithering technique(s) because the amplitude of the input current is so small that any undesirable acoustic effects (e.g., from vibrating capacitors) is negligible or undetectable.

Computer System

Figure 5:
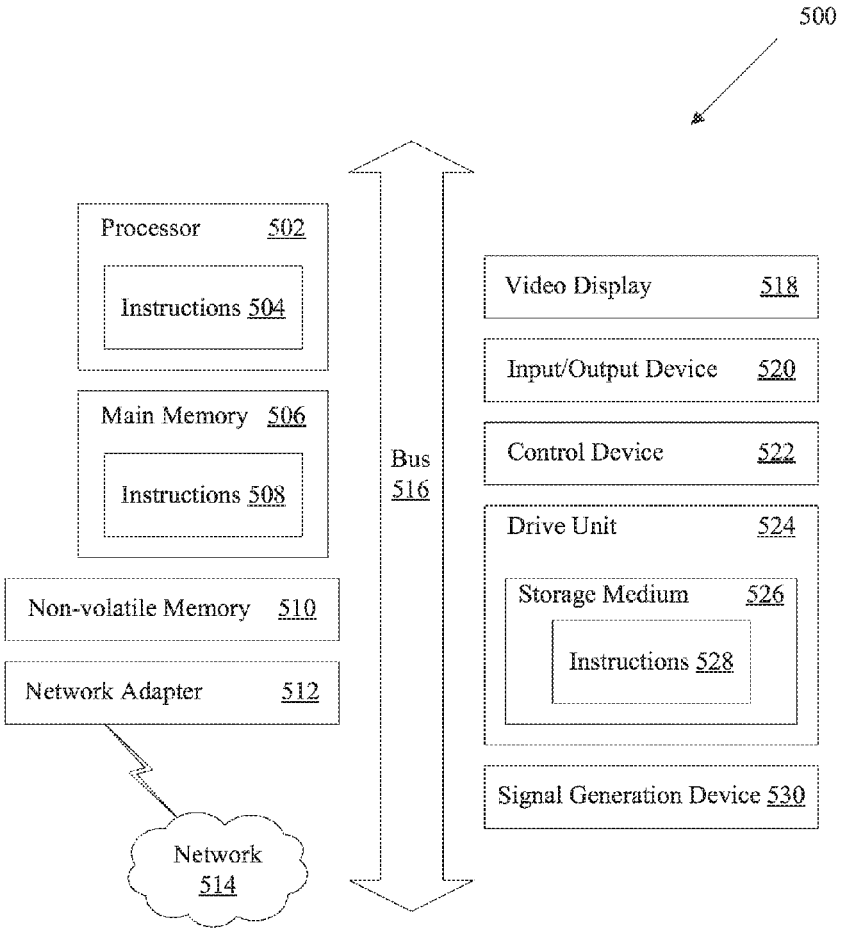
FIG. 5 is a block diagram illustrating an example of a computer system in which at least some operations described herein can be implemented.

FIG. 5 is a block diagram illustrating an example of a computing system 500 in which at least some operations described herein can be implemented. The computing system may include one or more central processing units ("processors") 502, main memory 506, non-volatile memory 510, network adapter 512 (e.g., network interfaces), video display 518, input/output devices 520, control device 522 (e.g., keyboard and pointing devices), drive unit 524 including a storage medium 526, and signal generation device 530 that are communicatively connected to a bus 516. The bus 516 is illustrated as an abstraction that represents any one or more separate physical buses, point to point connections, or both connected by appropriate bridges, adapters, or controllers. The bus 516, therefore, can include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

In various embodiments, the computing system 500 operates as a standalone device, although the computing system 500 may be connected (e.g., wired or wirelessly) to other machines. In a networked deployment, the computing system 500 may operate in the capacity of a server or a client machine in a client-server network environment, or as a peer machine in a peer-to-peer (or distributed) network environment.

The computing system 500 may be a server computer, a client computer, a personal computer (PC), a user device, a tablet PC, a laptop computer, a personal digital assistant (PDA), a cellular telephone, an iPhone, an iPad, a Blackberry, a processor, a telephone, a web appliance, a network router, switch or bridge, a console, a hand-held console, a (hand-held) gaming device, a music player, any portable, mobile, hand-held device, or any machine capable of executing a set of instructions (sequential or otherwise) that specify actions to be taken by the computing system.

While the main memory 506, non-volatile memory 510, and storage medium 526 (also called a "machine-readable medium) are shown to be a single medium, the term "machine-readable medium" and "storage medium" should be taken to include a single medium or multiple media (e.g., a centralized or distributed database, and/or associated caches and servers) that store one or more sets of instructions 528. The term "machine-readable medium" and "storage medium" shall also be taken to include any medium that is capable of storing, encoding, or carrying a set of instructions for execution by the computing system and that cause the computing system to perform any one or more of the methodologies of the presently disclosed embodiments.

In general, the routines executed to implement the embodiments of the disclosure, may be implemented as part of an operating system or a specific application, component, program, object, module or sequence of instructions referred to as "computer programs." The computer programs typically comprise one or more instructions (e.g., instructions 504, 508, 528) set at various times in various memory and storage devices in a computer, and that, when read and executed by one or more processing units or processors 502, cause the computing system 500 to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices 510, floppy and other removable disks, hard disk drives, optical disks (e.g., Compact Disk Read-Only Memory (CD ROMS), Digital Versatile Disks, (DVDs)), and transmission type media such as digital and analog communication links.

The network adapter 512 enables the computing system 1000 to mediate data in a network 514 with an entity that is external to the computing device 500, through any known and/or convenient communications protocol supported by the computing system 500 and the external entity. The network adapter 512 can include one or more of a network adaptor card, a wireless network interface card, a router, an access point, a wireless router, a switch, a multilayer switch, a protocol converter, a gateway, a bridge, bridge router, a hub, a digital media receiver, and/or a repeater.

The network adapter 512 can include a firewall which can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall may additionally manage and/or have access to an access control list which details permissions including for example, the access and operation rights of an object by an individual, a machine, and/or an application, and the circumstances under which the permission rights stand.

Other network security functions can be performed or included in the functions of the firewall, can include, but are not limited to, intrusion-prevention, intrusion detection, next-generation firewall, personal firewall, etc.

As indicated above, the techniques introduced here implemented by, for example, programmable circuitry (e.g., one or more microprocessors), programmed with software and/or firmware, entirely in special-purpose hardwired (i.e., non-programmable) circuitry, or in a combination or such forms. Special-purpose circuitry can be in the form of, for example, one or more application-specific integrated circuits (ASICs), programmable logic devices (PLDs), field-programmable gate arrays (FPGAs), etc.

Lighting System Topology

Figure 6A:
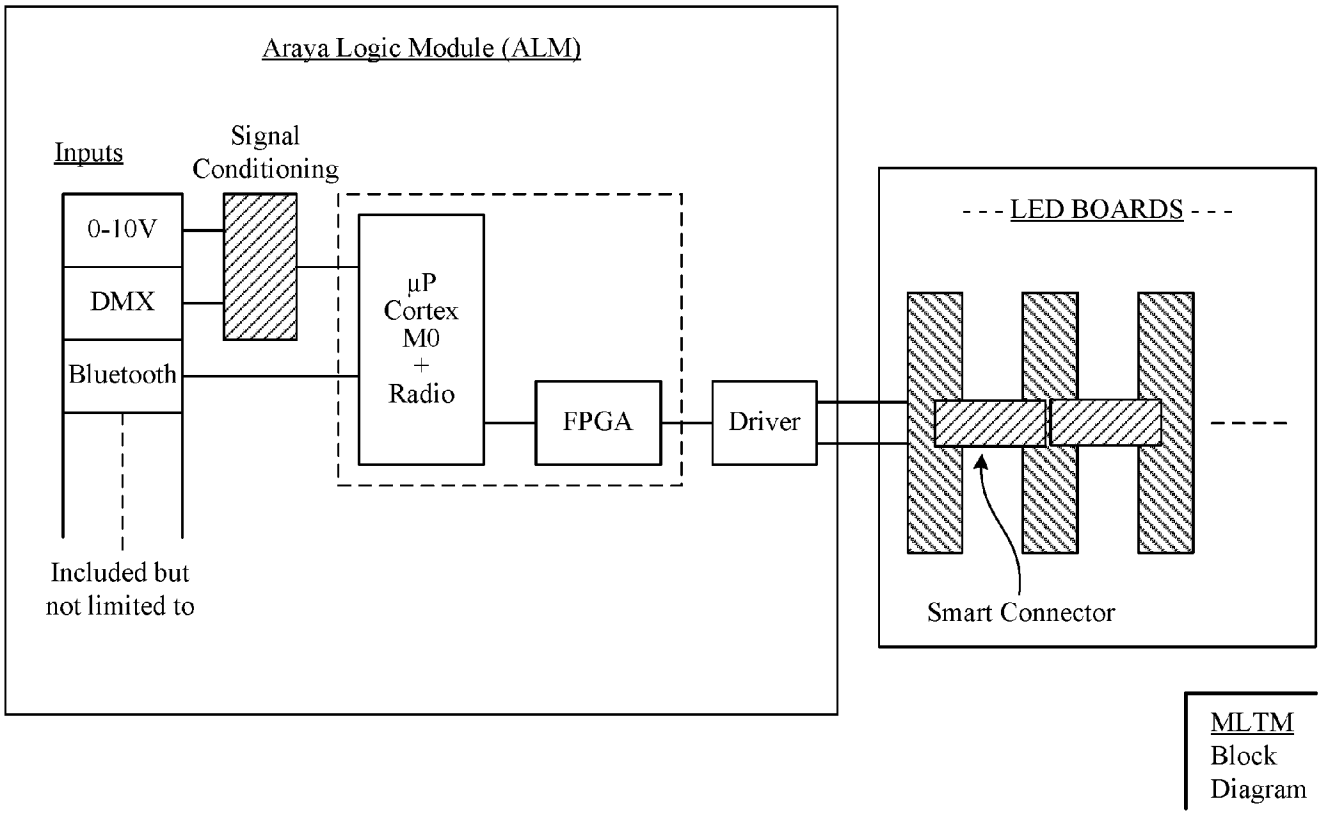
FIG. 6A is a high-level block diagram of an LED-based lighting system that includes a logic module connected to one or more LED boards.
Figure 6B:
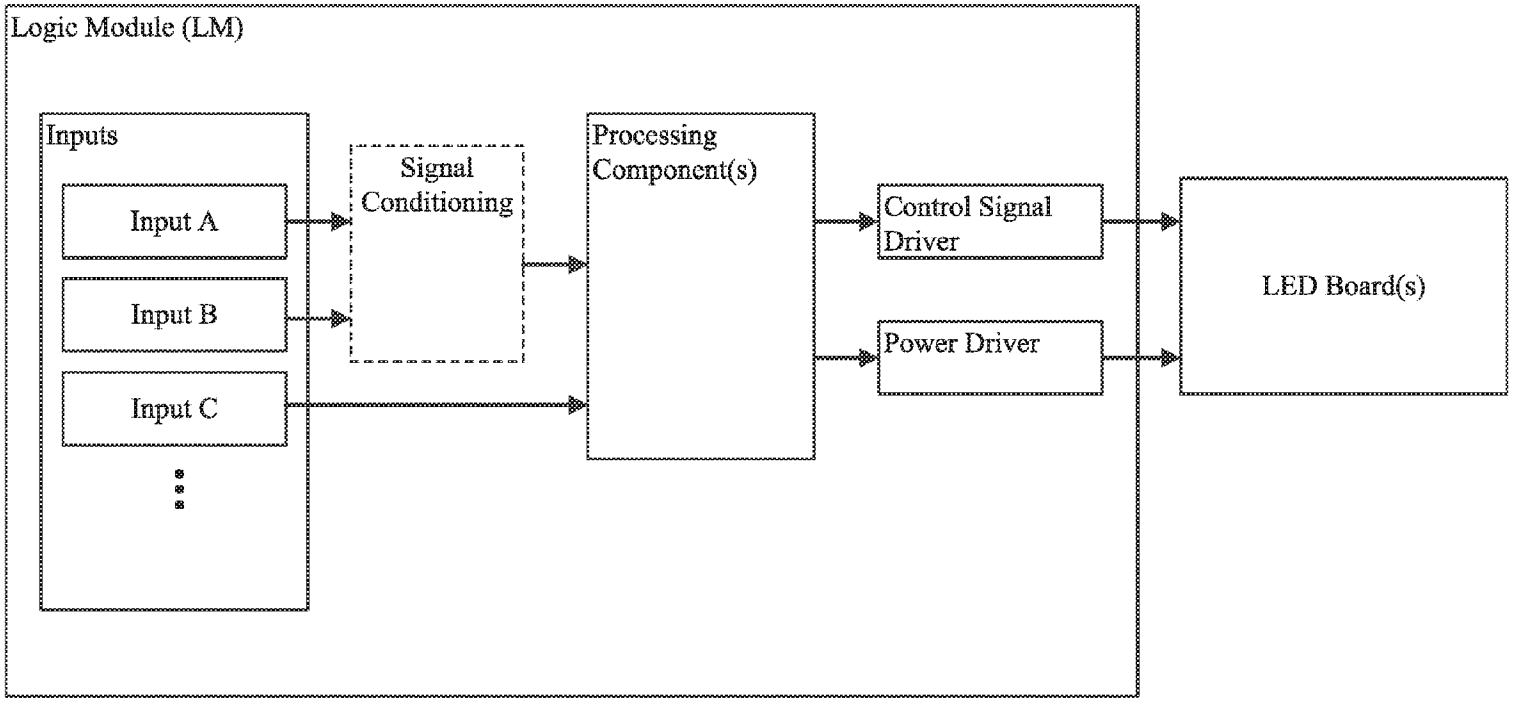
FIG. 6B is another high-level block diagram of an LED-based lighting system that includes a logic module connected to one or more LED boards
Figure 7:
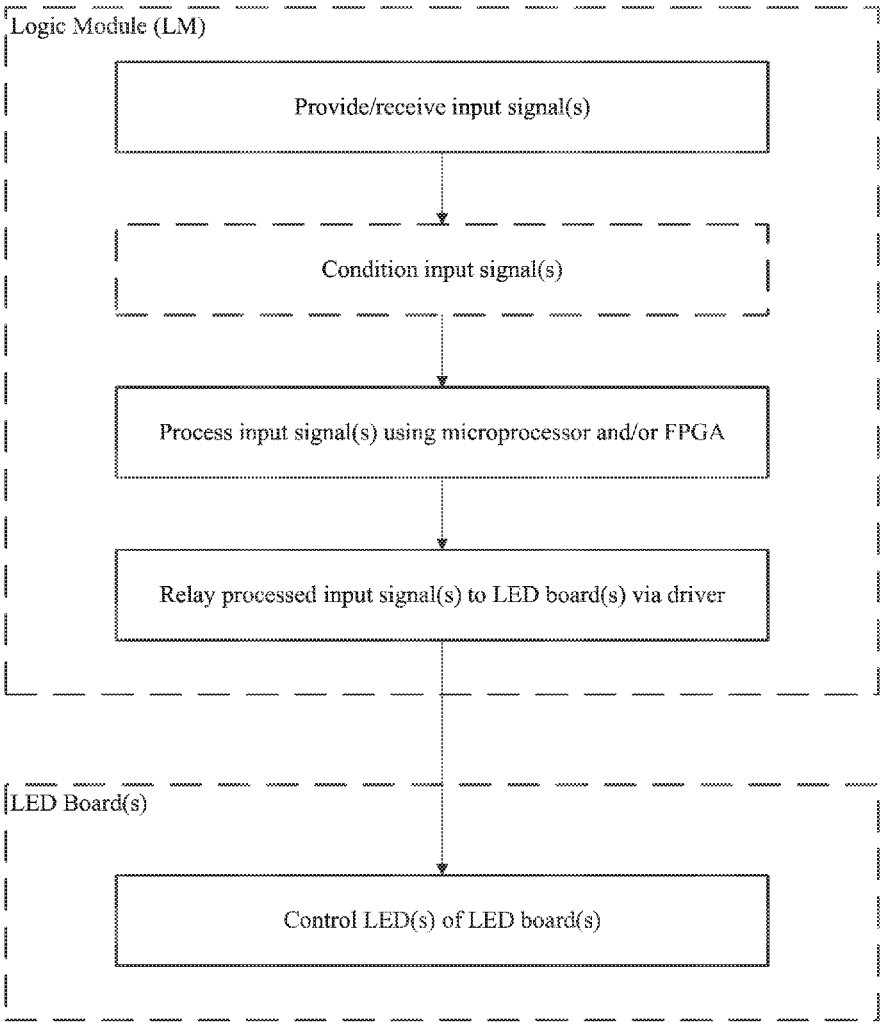
FIG. 7 depicts a process for controllably tuning one or more LED boards using a logic module.

FIGS. 6A-B are high-level block diagrams of an LED-based lighting system that includes a logic module connected to one or more LED boards, while FIG. 7 depicts a process for controllably tuning one or more LED boards using a logic module.

One or more input signals (e.g., input voltage, DMX, Bluetooth®) are received by the logic module and relayed to one or more processing components. The processing component(s) can include, for example, a microprocessor and FPGA. In some embodiments, some or all of the input signal(s) are conditioned (e.g., by a signal conditioning module) before being provided to the processing component(s). The input signal(s) prompt the logic module to control one or more LED boards in a certain manner. For example, the processing component(s) may selectively control a control signal driver, a power driver, or both, which interface with the LED board(s).

In some embodiments, the logic module selectively controls a primary LED board (e.g., using the control signal driver and/or power driver) that is coupled to a secondary LED board. For example, the primary LED board could be coupled to the secondary LED board by a smart connector that causes the driver signals provided to the primary LED board by the logic module to also be provided to the secondary LED board. Similarly, the secondary LED board may be coupled to additional secondary LED board(s) that act in unison with the primary LED board.

REMARKS

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. A dimming system comprising:

a color string that includes one or more light emitting diodes (LEDs) of a substantially similar color;

an adjustable current source configured to provide an electric current to the color string, wherein the adjustable current source has a minimum threshold level at which the adjustable current source is able to provide the electric current without producing leakage current;

an analog micro-pulse generator configured to provide an electric current pulse to the color string at an order smaller than the minimal threshold level;

a shunt circuit configured to short a current source at a specified frequency; and a controller that configures the adjustable current source, the analog micro-pulse generator, the shunt circuit, or a combination thereof based on a dimming level specified by a user, wherein, when the dimming level falls within a first dimming range, the controller configures the adjustable current source to drive the color string at an output level between a maximum threshold level and the minimum threshold level, and wherein, when the dimming level falls within a second dimming range lower than the first dimming range, the controller configures the adjustable current source to drive the color string at an output level matching the minimum threshold level and the shunt circuit to modulate the output level at a first frequency proportional to the dimming level.

2. The dimming system of claim 1, wherein the adjustable current source is a buck converter.

3. The dimming system of claim 1, wherein the current source is the adjustable current source or the analog micro-pulse generator.

4. The dimming system of claim 1, wherein the specified frequency corresponds to a duty cycle of the adjustable current source or the analog micro-pulse generator.

5. The dimming system of claim 1, wherein the first frequency exceeds an audible frequency range.

6. The dimming system of claim 1, wherein the first frequency exceeds 25 kHz.

7. The dimming system of claim 1, wherein, when the dimming level falls within a third dimming range lower than the second diming range, the controller configures the analog micro-pulse generator to drive the color string at an output level matching the order of the electric current pulse and the shunt circuit to modulate the output level at a second frequency proportional to the dimming level that exceeds an audible frequency range.

8. The dimming system of claim 7, wherein, when the dimming level falls within a fourth dimming range lower than the third dimming range, the controller configures the analog micro-pulse generator to drive the color string at an output level matching the order of the electric current pulse and the shunt circuit to modulate the particular output level at a third frequency proportional to the dimming level that does not exceed the audible frequency range.

9. The dimming system of claim 1, wherein the color string is one of a plurality of color strings, each color string including one or more light emitting diodes (LEDs) of a different color.

10. The dimming system of claim 1, wherein the one or more LEDs are housed within a light fixture, and wherein the controller is housed within a logic module that is communicatively coupled to the light fixture via a ribbon cable.

11. A method for controllably dimming a color string that includes one or more light emitting diodes (LEDs) of a substantially similar color, the method comprising:

acquiring user input that specifies a dimming level for the color string;

determining whether the dimming level falls within a first dimming range, a second dimming range lower than the first dimming range, a third dimming range lower than the second dimming range, or a fourth dimming range lower than the third dimming range; and based on said determining, controllably powering the color string by:

upon determining the dimming level falls within the first dimming range, configuring an adjustable current source to drive the color string by providing output current at a level between a maximum threshold level and a minimum threshold level achievable by the adjustable current source;

upon determining the dimming level falls within the second dimming range, configuring the adjustable current source to drive the color string by providing output current at a level matching the minimum threshold level, and configuring a shunt circuit to modulate the output current at a first frequency proportional to the dimming level;

upon determining the dimming level falls within the third dimming range, configuring an analog micro-pulse generator to drive the color string by providing output current at a level matching an electric current pulse that is an order smaller than the minimum threshold level, and configuring the shunt circuit to modulate the output current at a second frequency proportional to the dimming level that exceeds an audible frequency range; and upon determining the dimming level falls within the fourth dimming range, configuring the analog micro-pulse generator to drive the color string by providing output current at a level matching the electric current pulse, and configuring the shunt circuit to modulate the output current at a third frequency proportional to the dimming level that does not exceed an audible frequency range.

12. The method of claim 11, wherein the adjustable current source is a buck converter.

13. The method of claim 11, wherein a single shunt circuit controllably shorts the current adjustable current source and the analog micro-pulse generator.

14. The method of claim 11, wherein the first, second, and third frequencies are all different frequencies.

15. The method of claim 11, wherein the first frequency corresponds to a duty cycle of the adjustable current source, and wherein the second frequency corresponds to a duty cycle of the analog micro-pulse generator.

16. The method of claim 11, wherein the first and second frequencies exceed 25 kHz.

17. The method of claim 11, wherein the third frequency does not exceed 25 kHz.

18. The method of claim 11, wherein the color string is one of a plurality of color strings, each color string including one or more light emitting diodes (LEDs) of a different color.

* * * * *